United States Patent [19]

Goulvestre et al.

[11] 4,255,095

[45] Mar. 10, 1981

[54] TURBOPUMP

[75] Inventors: Loïc R. Y. Goulvestre; Claude M. M. Lepert, both of Annecy, France

[73] Assignee: Pompes Guinard, Courbedie, France

[21] Appl. No.: 58,280

[22] Filed: Jul. 17, 1979

[30] Foreign Application Priority Data

Aug. 7, 1978 [FR] France ..... 78 23250

[51] Int. Cl.[3] ..... F04B 17/00

[52] U.S. Cl. ..... 417/406

[58] Field of Search ..... 417/406, 407, 408, 409

[56] References Cited

U.S. PATENT DOCUMENTS

| | | | |
|---|---|---|---|
| 2,991,926 | 7/1961 | Diefenderfer | 417/406 |
| 3,173,241 | 3/1965 | Birmann | 417/406 X |
| 4,179,247 | 12/1979 | Osborn | 417/406 |

*Primary Examiner*—Christopher K. Moore

*Attorney, Agent, or Firm*—Frishauf, Holtz, Goodman & Woodward

[57] ABSTRACT

A turbopump set comprises a pump having an inlet and an outlet and a turbine having an inlet and an outlet. The pump and the turbine rotors are fixed on the same shaft, and their casings are coupled together at their high-pressure end.

5 Claims, 2 Drawing Figures

TURBOPUMP

Figure 1:
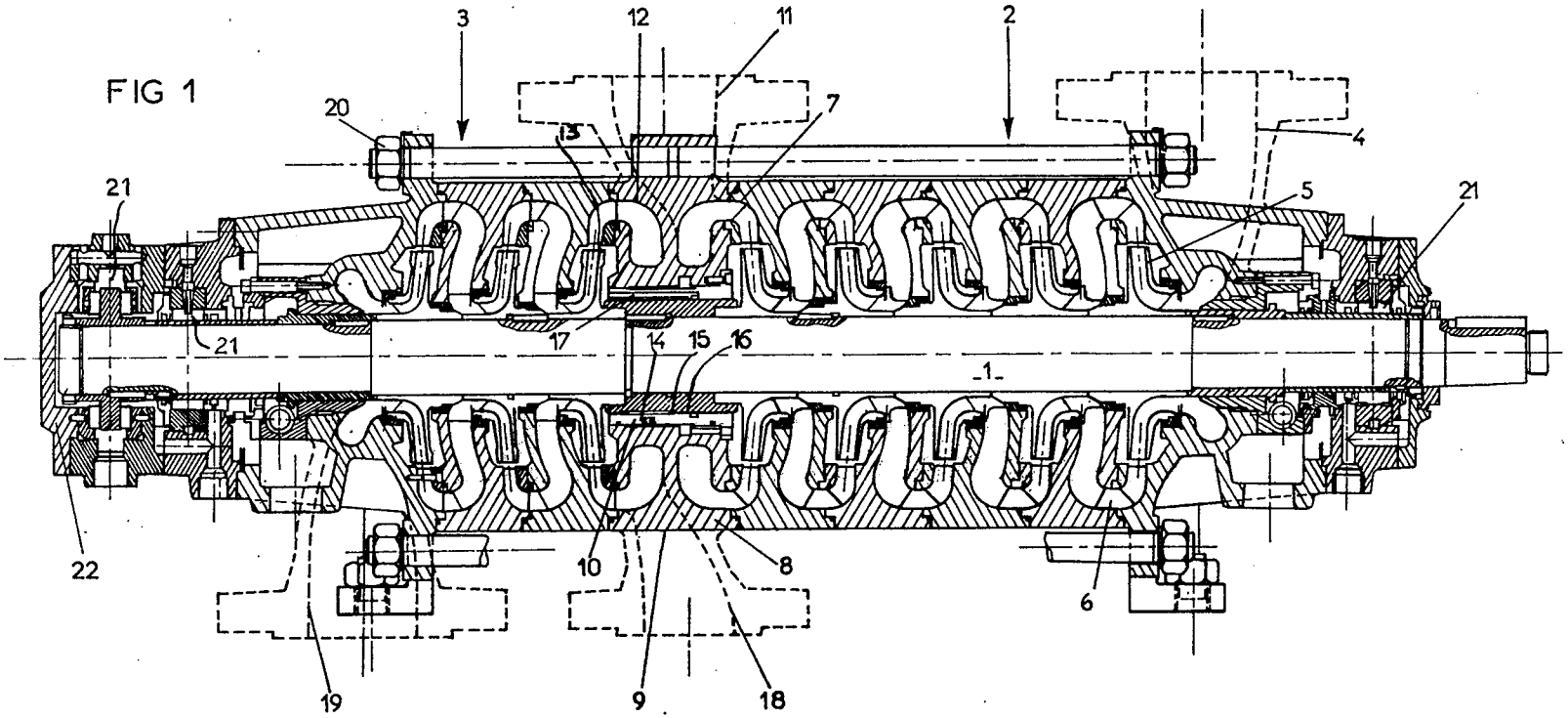

The invention concerns turbomachines comprising a pump, having an inlet and an outlet, and a turbine, which is fixed on the same shaft as the pump and one of whose ends is coupled to one of the ends of the pump.

A very compact turbine-pump unit, called an isogyre, is known, the turbomachine of which combines in one revolving unit a turbine wheel and a pump wheel, back to back, fixed on the same shaft and served by one common inlet and one common outlet. Independent sleeve-valves are disposed one at the inlet of the turbine wheel, the other at the outlet of the pump wheel. These valves allow one wheel to be isolated while the other works. This unit can function as pump or as turbine according to choice, but not both at the same time.

The turbopump according to the invention is also very compact and differs radically from this previous type of turbine-pump unit in that it operates as turbine and as pump simultaneously, the turbine-operation recovering energy for use in the pump-operation in particular. The turbomachine according to the invention normally has no means of interrupting the operation of the pump when the turbine is in operation or vice versa.

Consequently, the object of the invention is a turbomachine comprising a pump, having an inlet and an outlet, and a turbine which has an inlet and an outlet distinct from those of the pump, which is fixed on the same shaft as the pump and one of whose ends is coupled to one of the ends of the pump, characterised in that the pump and the turbine are coupled together at their high-pressure end.

The liquid coming from the pump can go to a treatment installation and issuing then from the latter, in, if need be, a modified formulation and state, but still under pressure, can enter the turbine to drive the shaft and consequently contribute to the operating of the pump. As the pump and the turbine are coupled together at their high-pressure end, the turbomachine must only be sealed, as regards the exterior, in the axial direction, at its free, low-pressure, ends. The pump compartment itself serves as basic sealing member for the high-pressure side of the turbine compartment and the turbine compartment serves the same purpose with regard to the pump compartment.

When the pump and the turbine receive liquids of the same or compatible nature, the two compartments can communicate through their coupled end. Otherwise, they can be separated by a separate sealing member which, subjected on both sides to relatively high pressures, does not have to be strong enough to ensure sealing of the high-pressure end of the pump or of the turbine with regard to the exterior. In this variant, a balance of axial pressures is also obtained.

The turbopump comprises an intermediate revolving part which defines, between one internal side face and one external side face, a pump volute and a turbine chamber on both sides of a plane perpendicular to the side faces and which carries a hydrostatic bearing whose chamber communicates with the pump. The bearing is thus supplied with the aid of the pumped liquid. This greatly simplifies the supply circuits of the bearing whose lift is established by acting on the difference in pressure of the liquid at the outlet of the pump and at the inlet of the turbine.

To balance the pressures on the bearing, it is a good idea to put a labyrinth between the chamber of the bearing and the pump.

A driving engine supplying additional power for the pump can drive the common shaft. This engine is preferably disposed at the side of the free end of the pump, so that the latter receives energy from two sides.

Figure 2:
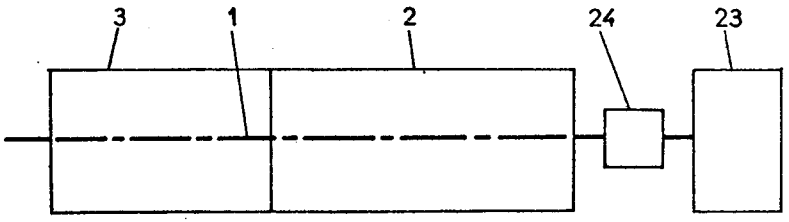

In the attached drawing, given solely by way of example:

FIG. 1 is a view in axial section of a turbomachine according to the invention; and FIG. 2 is a diagram of a variant.

The turbomachine represented essentially comprises a shaft driving in rotation impellers housed in a fixed pump compartment 2 and turbine wheels housed in a fixed turbine compartment 3, these two compartments being coupled together at their high-pressure ends.

The pump 2, at the free end, has a radial inlet aperture 4 opening in front of an impeller 5 followed by a diffuser 6 of a first stage, which is followed by four identical stages, except that the volute 7 forming the diffuser of the last stage is provided in an intermediate annular part 8 with an external surface 9 and an internal surface 10. A radial outlet aperture 11 of the pump 2 opens into the volute 7. The intermediate part 8 also defines a chamber 12, opening into a first turbine wheel 13, symmetrical with the pump volute 7 in relation to a plane perpendicular to the axis of the shaft 1. The fixed part 8 supports the shaft 1 via a hydrostatic bearing 14 whose chamber 15 communicates via a labyrinth 16 with the coupled end of the pump compartment 2 and via a low-pressure return pipe 17 with the coupled end of the turbine compartment 3.

The latter is done in two other turbine stages identical to the first.

A radial inlet aperture 18 for the turbine 3 is provided in the intermediate part 8. This aperture 18 is diametrically opposite the aperture 11 or can be perpendicular to it.

At the free end of the turbine 3 is provided a radial outlet aperture 19 for the turbine.

The assembly of the hydraulic package 2, 3, 8 is maintained by attachments 20, while, at each free end of the turbomachine, are provided lubricated bearings 21 and sealing parts 22.

Sea water enters through the admission aperture 4 of the pump 2 under a pressure P0. It passes through pump 2 and leaves through the discharge aperture 11 of the pump 2 under a pressure $P1 > P0$. It is sent to an inverse osmosis installation (not shown) from which it partly returns under a pressure $P2 < P1$ to enter into the turbine 3 through the admission aperture 18. It leaves again via the aperture 19, after having passed through the turbine 3, under a pressure P3 much less than P2, having thus given up energy, which allows the shaft 1 to be driven and thus contributes to making the pump 2 operate. The energy saving obtained can reach 50%.

In FIG. 2, a driving engine 23 drives the shaft 1 through a coupling 24. The pump 2 is inserted between the turbine 3 and the engine 23.

References known by Applicants are U.S. Pat. No. 3,391,642, French Pat. No. 2,040,794 and Swiss Pat. No. 223,835.

What we claim is:

1. A turbomachine comprising a pump with a rotor and a stator, said stator having an inlet and an outlet, a turbine having a rotor and a casing which has an inlet and an outlet distinct from those of the pump, the turbine rotor being fixed on a same shaft as the pump rotor and the pump and the turbine having respectively high-pressure ends, and an intermediate annular casing joining said ends and defining between an internal surface and an external surface thereof a pump volute and a turbine chamber on opposite sides of a plane perpendicular to said surfaces so that the intermediate casing is part of both of turbine liquid flowpath and the pump liquid flowpath, the intermediate casing further supporting a hydrostatic bearing whose chamber communicates with the pump.

2. A turbomachine according to claim 1, characterized in that the chamber communicates with the pump through a labyrinth.

3. A turbomachine according to claim 2, characterized in that the chamber communicates with the turbine via return pipes.

4. A turbomachine according to any of claims 1, and including a driving engine for driving the shaft.

5. A turbomachine according to claim 4, characterized in that the driving engine is disposed at the end of the pump, remote from the turbine.

* * * * *